US011100873B2

(12) United States Patent
Yeh et al.

(10) Patent No.: US 11,100,873 B2
(45) Date of Patent: Aug. 24, 2021

(54) DISPLAY SYSTEM

(71) Applicant: AU OPTRONICS CORPORATION, Hsin-Chu (TW)

(72) Inventors: Chi-Lung Yeh, Hsin-Chu (TW); Tzu-Hui Hsu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/010,979

(22) Filed: Sep. 3, 2020

(65) Prior Publication Data

US 2021/0174750 A1 Jun. 10, 2021

(30) Foreign Application Priority Data

Dec. 5, 2019 (TW) ..... 108144570

(51) Int. Cl.
*G09G 3/34* (2006.01)

(52) U.S. Cl.
CPC ..... *G09G 3/3406* (2013.01); *G09G 2300/0842* (2013.01); *G09G 2310/08* (2013.01)

(58) Field of Classification Search
None
See application file for complete search history.

(56) References Cited

U.S. PATENT DOCUMENTS

2005/0140640 A1* 6/2005 Oh ..... G09G 3/3406 345/102
2005/0146532 A1* 7/2005 Miyazaki ..... G09G 3/342 345/600
2007/0262733 A1* 11/2007 Lin ..... H05B 41/282 315/312
2010/0214207 A1* 8/2010 Hosoki ..... H05B 41/3927 345/101
2010/0231602 A1* 9/2010 Huang ..... G09G 3/3406 345/589
2016/0293115 A1* 10/2016 Yamashita ..... H05B 45/3725
2020/0143756 A1* 5/2020 Chen ..... G09G 3/3406

FOREIGN PATENT DOCUMENTS

CN 106488155 A 3/2017
CN 108419331 A 8/2018

* cited by examiner

*Primary Examiner* — Dorothy Harris
(74) *Attorney, Agent, or Firm* — WPAT, PC

(57) ABSTRACT

A display system includes a memory, a timing controller, a backlight module, a backlight controller, and a display array. The memory is configured to store a first look-up table and a second look-up table. The timing controller is configured to determine a target illumination value according to a target duty cycle of a backlight control signal and the first look-up table, and determine an original duty cycle according to the target illumination value and the second look-up table, and output the backlight control signal according to the original duty cycle. The backlight controller is configured to control the backlight module according to the backlight control signal. The display array is configured to cooperate with the backlight module to display an image.

10 Claims, 6 Drawing Sheets

LUT1

| BC(%) | standard illumination value + standard percentage (10%)(cd/m^2) | target illumination value (10%)(cd/m^2) | standard illumination value - standard percentage (10%)(cd/m^2) |
|---|---|---|---|
| 0.0 | 0 | 0 | 0 |
| 0.4 | 4.28 | 3.64 | 3.51 |
| 0.8 | 8.57 | 7.31 | 7.01 |
| 1.2 | 12.85 | 12.08 | 10.52 |
| 1.6 | 17.14 | 14.77 | 14.02 |
| 2.0 | 21.42 | 20.62 | 17.53 |
| 2.4 | 25.71 | 23.72 | 21.03 |

FIG. 2

LUT2

| BC(%) | original illumination value (cd/m^2) |
|---|---|
| 0.0 | 0.06 |
| 0.4 | 0.10 |
| 0.8 | 0.27 |
| 1.2 | 0.66 |
| 1.6 | 1.33 |
| 2.0 | 2.31 |
| 2.4 | 3.64 |
| 2.8 | 5.32 |
| 3.2 | 7.31 |
| 3.6 | 9.60 |
| 4.0 | 12.08 |
| 4.4 | 14.77 |
| 4.8 | 17.63 |
| 5.2 | 20.62 |
| 5.6 | 23.72 |

FIG. 3

DISPLAY SYSTEM

RELATED APPLICATIONS

This application claims priority to Taiwanese Application Serial Number 108144570 filed Dec. 5, 2019, which is herein incorporated by reference.

BACKGROUND

Technical Field

The present disclosure relates to a display technology. More particularly, the present disclosure relates to a display system.

Description of Related Art

With developments of display technology, display systems have been applied to various electrical devices. In general, a display system at least includes a display array and a backlight module. The display array cooperates with the backlight module to display an image. However, in some related approaches, linearity between illumination and a backlight control signal configured to control the backlight module is poor. In this situation, the display systems in these related approaches have worse visual effect.

SUMMARY

One embodiment of the present disclosure is related to a display system. The display system includes a memory, a timing controller, a backlight module, a backlight controller, and a display array. The memory is configured to store a first look-up table and a second look-up table. The timing controller is configured to determine a target illumination value according to a target duty cycle of a backlight control signal and the first look-up table, and determine an original duty cycle according to the target illumination value and the second look-up table, and output the backlight control signal according to the original duty cycle. The backlight controller is configured to control the backlight module according to the backlight control signal. The display array is configured to cooperate with the backlight module to display an image.

One embodiment of the present disclosure is related to a display system. The display system includes a timing controller and a display panel. The timing controller is configured to determine a first mode or a second mode according to display data. In the first mode, the timing controller increases a frequency of an original backlight control signal. In the second mode, the timing controller increases a resolution of the original backlight control signal. The display panel is configured to be controlled based on the display data the adjusted backlight control signal, to display an image.

As the above embodiments, the display system of the present disclosure has better visual effect.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows:

FIG. 2 is a schematic diagram illustrating a look-up table according to some embodiments of the present disclosure.

FIG. 3 is a schematic diagram illustrating a look-up table according to some embodiments of the present disclosure.

DETAILED DESCRIPTION

Figure 1:
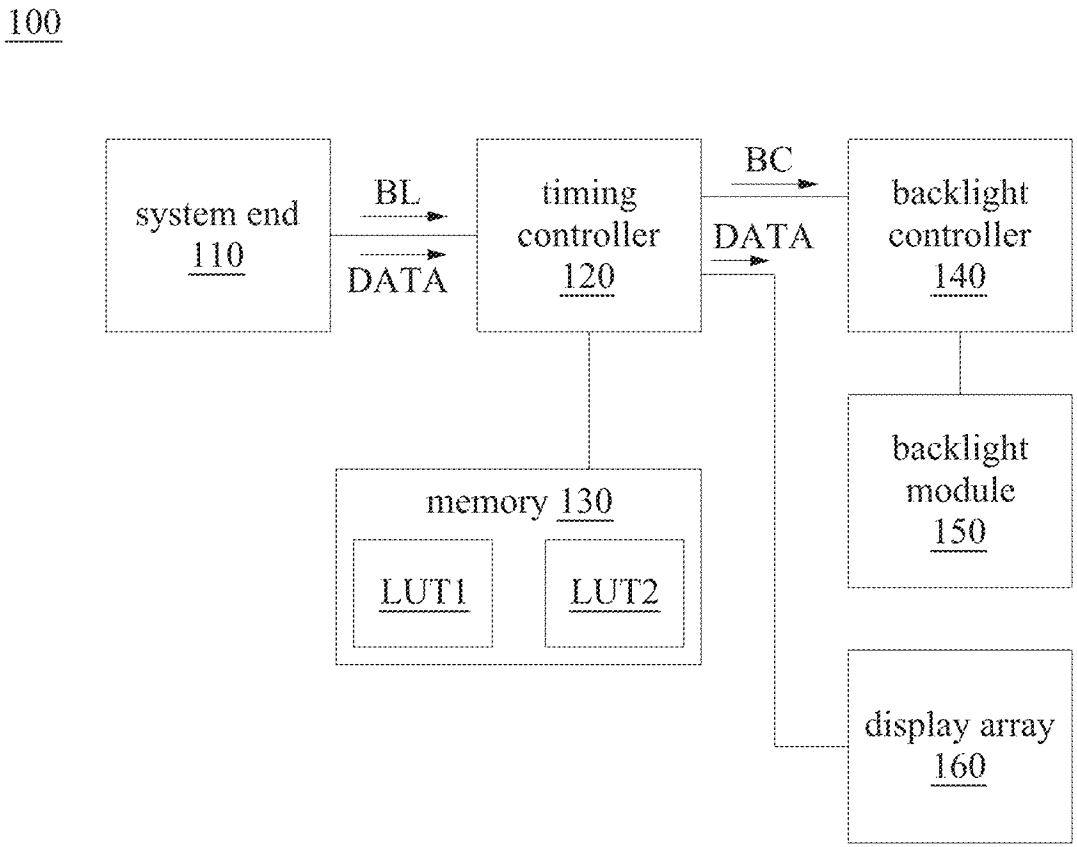
FIG. 1 is a schematic diagram illustrating a display system according to some embodiments of the present disclosure.

Reference is now made in detail to the present embodiments of the disclosure, examples of which are illustrated in the accompanying drawings. Wherever possible, the same reference numbers are used in the drawings and the description to refer to the same or like parts. The embodiments below are described in detail with the accompanying drawings, but the examples provided are not intended to limit the scope of the disclosure covered by the description. The structure and operation are not intended to limit the execution order. Any structure regrouped by elements, which has an equal effect, is covered by the scope of the present disclosure.

Various embodiments of the present technology are discussed in detail below with figures. It should be understood that the details should not limit the present disclosure. In other words, in some embodiments of the present disclosure, the details are not necessary. In addition, for simplification of figures, some known and commonly used structures and elements are illustrated simply in figures.

In the present disclosure, "connected" or "coupled" may refer to "electrically connected" or "electrically coupled." "Connected" or "coupled" may also refer to operations or actions between two or more elements.

Reference is made to FIG. 1. FIG. 1 is a schematic diagram illustrating a display system 100 according to some embodiments of the present disclosure. As illustrated in FIG. 1, the display system 100 includes a system end 110, a timing controller (TCON) 120, a memory 130, a backlight controller 140, a backlight module 150, and a display array 160. The system end 110 is coupled to the timing controller 120. The timing controller 120 is coupled to the memory 130, the backlight controller 140, and the display array 160. The backlight controller 140 is coupled to and is configured to control the backlight module 150.

In some embodiments, the memory 130 may be implemented by non-transitory computer readable storage medium. The non-transitory computer readable storage medium is, for example, a ROM, a flash memory, a floppy disk, a hard disk, a compact disk, a flash disk, a pen driver, a magnetic tape, a data base read via a network, or other storage medium having the same function. In some embodiments, the memory 130 is configured to store a look-up table LUT1 and a look-up table LUT2.

In operation, the system end 110 outputs a backlight signal BL and display data DATA to the timing controller 120. The timing controller 120 processes the backlight signal BL according to the look-up table LUT1 and the look-up table LUT2 stored in the memory 130, to generate a backlight control signal BC. The backlight controller 140 controls the backlight module 150 according to the backlight control signal BC. The timing controller 120 outputs the display data DATA to the display array 160. The display array 160 cooperates with the backlight module 150 to display an image corresponding to the display data DATA.

Reference is made to FIG. 2. FIG. 2 is a schematic diagram illustrating the look-up table LUT1 according to some embodiments of the present disclosure. Based on a display standard with better linearity, the look-up table LUT1 defines a corresponding relationship between a plurality of target duty cycles of the backlight control signal BC and a plurality of target illumination values. If a display system satisfies to the look-up table LUT1, it is that the display system satisfies the aforementioned display standard with better linearity.

In the look-up table LUT1, each target duty cycle of the backlight control signal BC corresponds to a target illumination value. As illustrated in FIG. 2, when the target duty cycle of the backlight control signal BC is 0.4%, the corresponding target illumination value 3.64 (cd/m$^2$).

In specific, each target duty cycle of the backlight control signal BC corresponds to a standard illumination value. The standard illumination value defines a target illumination range. An upper limit value of the target illumination range may be a sum of a standard illumination value and a standard percentage, and a lower limit value may be a difference between the standard illumination value and the standard percentage. In this example, the standard percentage is equal to 10% or less than 10%, but the present disclosure is not limited thereto. Various suitable standard percentages are within the contemplated scopes of the present disclosure. The target illumination value is included in the target illumination range.

As illustrated in FIG. 2, when the target duty cycle of the backlight control signal BC is 0.4%, the target illumination range is 4.28-3.51 (cd/m$^2$). The system sets a value in the target illumination range to be a target illumination value. The target illumination value preferably is a middle value between the upper limit value and the lower limit value of the target illumination range, but the present disclosure is not limited thereto. As illustrated in FIG. 2, when the target duty cycle of the backlight control signal BC is 0.4%, the target illumination range is 4.28-3.51 (cd/m$^2$), and the target illumination value is 3.64 (cd/m$^2$).

Reference is made to FIG. 3. FIG. 3 is a schematic diagram illustrating the look-up table LUT2 according to some embodiments of the present disclosure. The look-up table LUT2 defines a corresponding relationship between a plurality of original duty cycles of the backlight control signal BC and a plurality of original illumination values of the display system 100.

As illustrated in FIG. 3, the look-up table LUT2 records original characteristic of the display system 100. In other words, without any extra control, when the original duty cycle of the backlight control signal BC is 0.4%, the original illumination value of the display system 100 is 0.10 (cd/m$^2$), but the aforementioned target illumination value is 3.64 (cd/m$^2$). Based on these, without any extra control, the original illumination value of the backlight control signal BC is different from the target illumination value.

Figure 4:
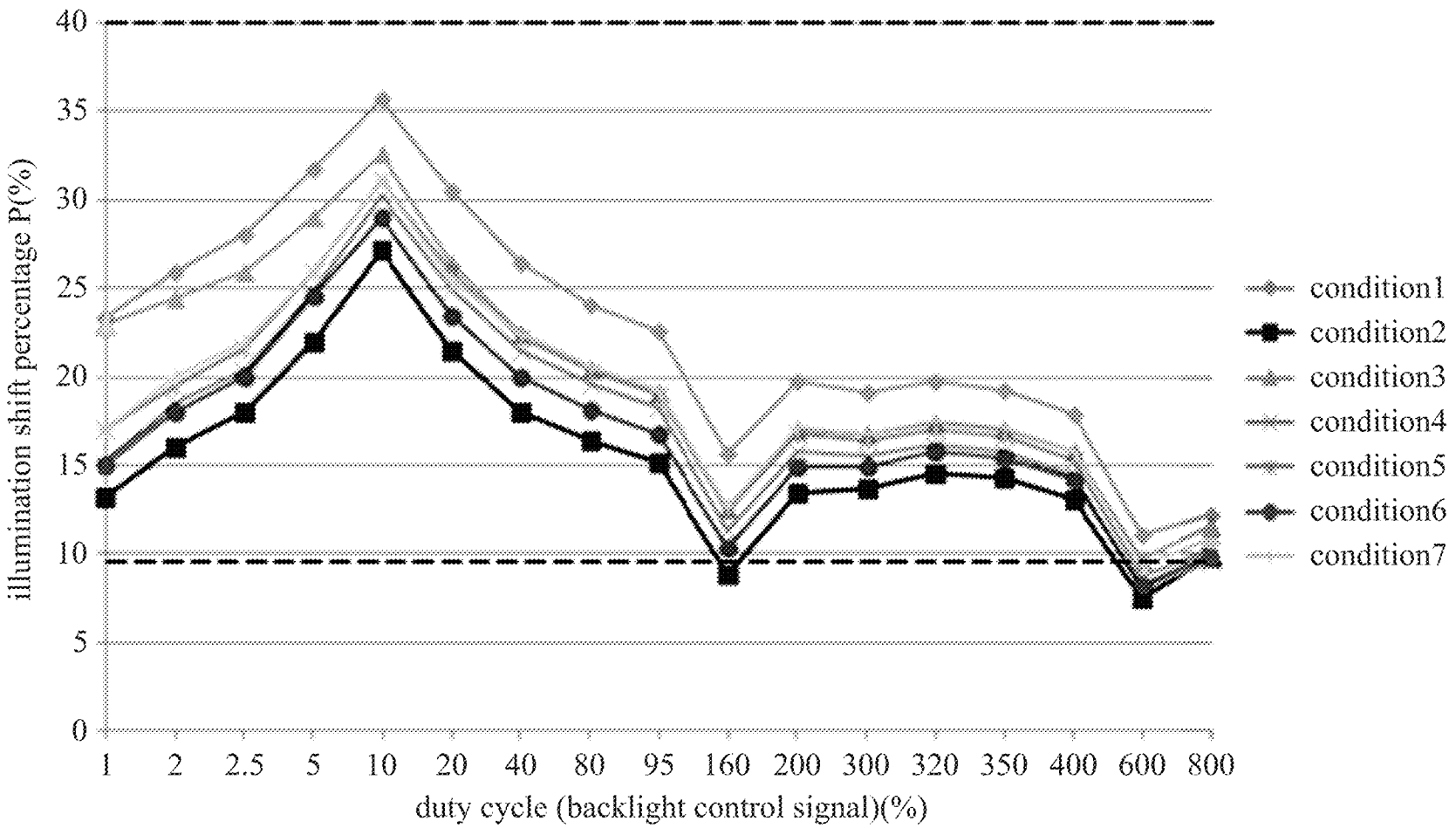
FIG. 4 is a schematic diagram illustrating some related approaches according to some embodiments of the present disclosure.

FIG. 4 is a schematic diagram illustrating some related approaches according to some embodiments of the present disclosure. In some related approaches, when the original duty cycle of the backlight control signal BC is smaller, an illumination shift percentage P is higher. The illumination shift percentage P can be derived from the formula (1) below:

$$P=(L1-L2)/(L2) \quad (1)$$

L1 is a practical illumination value, and L2 is a target illumination value. As illustrated in FIG. 4, when the original duty cycle of the backlight control signal BC is smaller, the illumination shift percentage P is higher (the practical illumination value shifts from the target illumination value severely). In other words, when the original duty cycle of the backlight control signal BC is smaller, linearity between the original duty cycle of the backlight control signal BC and the practical illumination value is poorer.

Compared to the related approaches above, the timing controller 120 of the present disclosure determines, based on the display standard with better linearity (the look-up table LUT1), the target illumination value according to the target duty cycle of the backlight control signal BC. Then, the timing controller 120 determines the original duty cycle of the backlight control signal BC based on the target illumination value and the characteristic of the display system 100 (the look-up table LUT2). Then, the timing controller 120 outputs the backlight control signal BC according to this original duty cycle, such that the backlight controller 140 controls the backlight module 150 according to the backlight control signal BC.

For example, if the target illumination duty cycle of the backlight control signal BC is 0.4%, the timing controller 120 determines, according to the look-up table LUT1 in FIG. 2, that the target illumination value is 3.64 (cd/m$^2$). Then, the timing controller 120 determines, according to the look-up table LUT2 in FIG. 3, the original duty cycle is 2.4%. Accordingly, the timing controller 120 outputs the backlight control signal BC and the duty cycle of the backlight control signal BC is 2.4%, such that the backlight controller 140 controls the illumination value of the backlight module 150 to be 3.64 (cd/m$^2$). Thus, the display system 100 satisfies the display standard with better linearity.

Based on descriptions above, the display system 100 can adjust the final illumination value to satisfy the display standard with better linearity, to improve poor linearity between the backlight control signal BC and the final illumination value. Accordingly, the display system 100 of the present disclosure has a better visual effect.

In addition, as described above, when the original duty cycle of the backlight control signal BC is smaller, linearity between the original duty cycle of the backlight control signal BC and the practical illumination value is poor. Accordingly, in some embodiments, the operations above are operated when the duty cycle of the backlight control signal BC is lower than 35%, to improve linearity of the dark portion.

Figure 5:
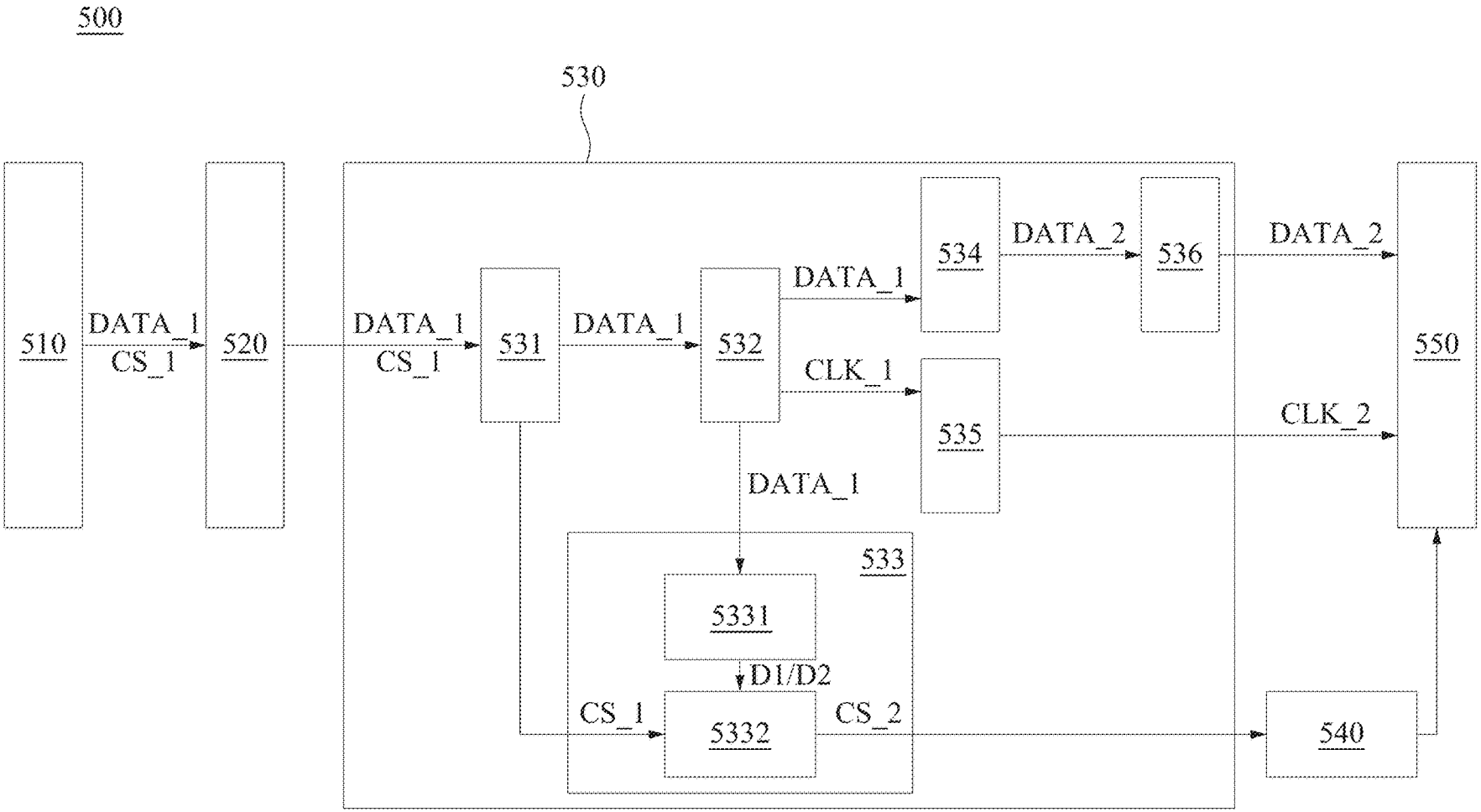
FIG. 5 is a schematic diagram illustrating a display system according to some embodiments of the present disclosure.

Reference is made to FIG. 5. FIG. 5 is a schematic diagram illustrating a display system 500 according to some embodiments of the present disclosure. As illustrated in FIG. 5, the display system 500 includes a system end 510, a graphics processing unit (GPU) 520, a timing controller 530, a driver circuit 540, and a display panel 550. The system end 510 is coupled to the graphics processing unit 520. The graphics processing unit 520 is coupled to the timing controller 530. The timing controller 530 is coupled to the driver circuit 540 and the display panel 550. The driver circuit 540 is coupled to the display panel 550.

The timing controller 530 includes a receiver (Rx) circuit 531, a latch circuit 532, a control circuit 533, a processor 534, a timing signal generator 535, and a transmitter (Tx) circuit 536. The control circuit 533 includes a determination circuit 5331 and a controller 5332.

In some embodiments, the system end 510 outputs display data DATA_1 and an original backlight control signal CS_1.

A frequency of the original backlight control signal CS_1 and a resolution of the original backlight control signal CS_1 (resolution of the backlight module) satisfy the formula (2) below:

$$FX=F_vsync \times PWM_period \quad (2)$$

F_vsync is the frequency of the original backlight control signal CS_1, PWM_period is corresponding to the resolution of the original backlight control signal CS_1 (resolution of the backlight module), an FX is a fixed value. In other words, the frequency of the original backlight control signal CS_1 is inversely proportional to the resolution of the original backlight control signal CS_1 (resolution of the backlight module).

The graphics processing unit 520 sends the display data DATA_1 and the original backlight control signal CS_1 from the system end 510 to the receiver circuit 531 of the timing controller 530. The receiver circuit 531 sends the display data DATA_1 to the latch circuit 532. The latch circuit 532 sends the display data DATA_1 to the determination circuit 5331 of the control circuit 533 and the processor 534, and sends an original timing control signal CLK_1 to the timing signal generator 535. On the other hand, the receiver circuit 531 sends the original backlight control signal CS_1 to the controller 5332 of the control circuit 533.

The determination circuit 5331 can determine that the display data DATA_1 is in a high variation mode (for example, dynamic image) or in a low variation mode (for example, static image) according to the display data DATA_1. When the determination circuit 5331 determines that the display data DATA_1 is in a high variation mode, the determination circuit 5331 outputs a determination signal D1 corresponding to the high variation mode. Accordingly, the controller 5332 adjusts the frequency of the original backlight control signal CS_1 to be higher and adjusts the resolution PWM_period to be lower, to output the adjusted backlight control signal CS_2. The driver circuit 540 controls the backlight module of the display panel 550 according to the adjusted backlight control signal CS_2.

When the determination circuit 5331 determines that the display data DATA_1 is in a low variation mode, the determination circuit 5331 outputs a determination signal D21 corresponding to the low variation mode. Accordingly, the controller 5332 adjusts the resolution PWM_period to be higher and adjusts the frequency of the original backlight control signal CS_1 to be lower, to output the adjusted backlight control signal CS_2. The driver circuit 540 controls the backlight module of the display panel 550 according to the adjusted backlight control signal CS_2.

The processor 534 is configured to process the display data DATA_1, to generate output data DATA_2. The transmitter circuit 536 sends the output data DATA_2 to the display panel 550. The timing signal generator 535 is configured to output a timing control signal CLK_2 according the original timing control signal CLK_1. The display panel 550 is controlled based on the output data DATA_2, the timing control signal CLK_2, and the adjusted backlight control signal CS_2, to display the corresponding image.

Figure 6:
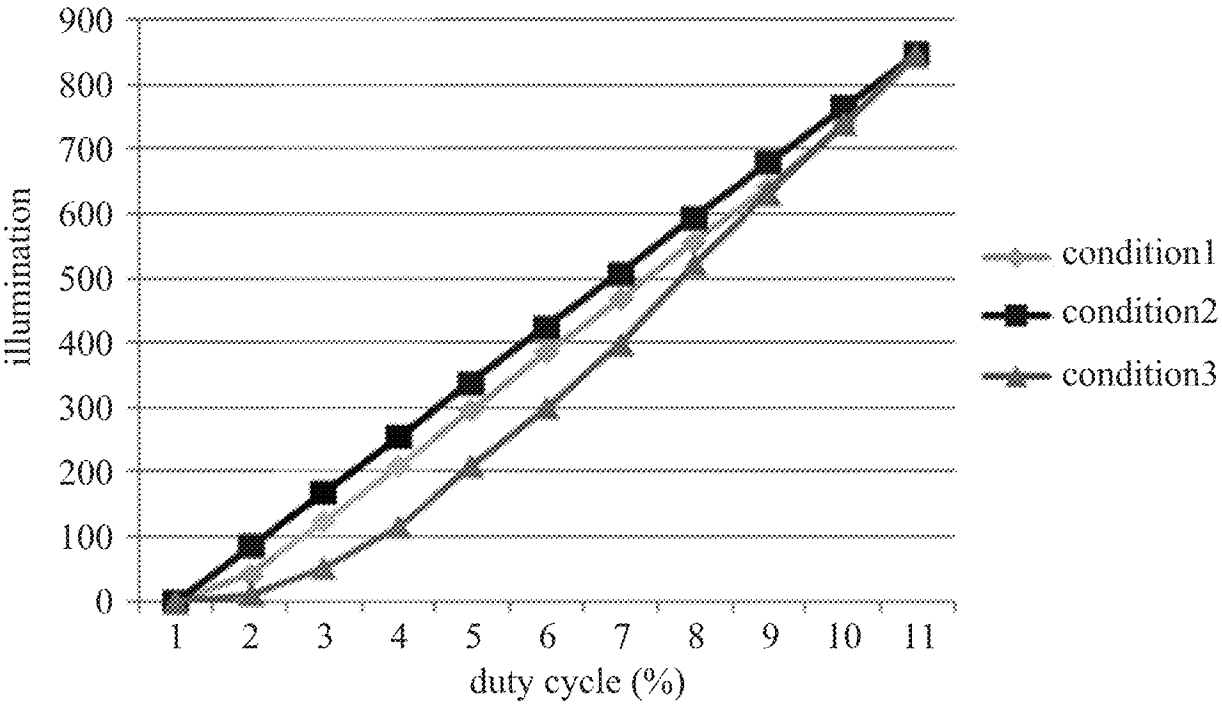
FIG. 6 is a schematic diagram illustrating some related approaches according to some embodiments of the present disclosure.

Reference is made to FIG. 6. FIG. 6 is a schematic diagram illustrating some related approaches according to some embodiments of the present disclosure. As illustrated in FIG. 6, in some related approaches, under some conditions, linearity between the illumination and the duty cycle of the backlight control signal is poor.

Compared to the related approaches above, the display system 500 of the present disclosure, the frequency of the original backlight control signal CS_1 is adjusted to be higher in the high variation mode, and this can make the response time to be faster, such that the backlight of the backlight module of the display panel 550 and data can be matched better. The resolution of PWM_period is adjusted to be higher in the low variation mode, and this can improve linearity between the illumination and the level number of the backlight. Accordingly, the display system 500 of the present disclosure can have better visual effect.

As the above embodiments, the display system of the present disclosure has better visual effect.

Various functional components or blocks have been described herein. As will be appreciated by persons skilled in the art, in some embodiments, the functional blocks will preferably be implemented through circuits (either dedicated circuits, or general purpose circuits, which operate under the control of one or more processors and coded instructions), which will typically comprise transistors or other circuit elements that are configured in such a way as to control the operation of the circuitry in accordance with the functions and operations described herein. As will be further appreciated, the specific structure or interconnections of the circuit elements will typically be determined by a compiler, such as a register transfer language (RTL) compiler. RTL compilers operate upon scripts that closely resemble assembly language code, to compile the script in a form that is used for the layout or fabrication of the ultimate circuitry. Indeed, RTL is well known for its role and use in the facilitation of the design process of electronic and digital systems.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display system, comprising:

a memory configured to store a first look-up table and a second look-up table;

a timing controller configured to determine a target illumination value according to a target duty cycle of a backlight control signal and the first look-up table, and determine an original duty cycle according to the target illumination value and the second look-up table, and output the backlight control signal according to the original duty cycle;

a backlight module;

a backlight controller configured to control the backlight module according to the backlight control signal; and a display array configured to cooperate with the backlight module to display an image.

2. The display system of claim 1, wherein the first look-up table at least defines a corresponding relationship between the target duty cycle and the target illumination value, wherein the corresponding relationship satisfies a display standard.

3. The display system of claim 2, wherein the target illumination value is in a target illumination range, an upper limit value of the target illumination range is a sum of a standard illumination value and a standard percentage, and a lower limit value is a difference between the standard illumination value and the standard percentage.

4. The display system of claim 3, wherein the standard percentage is equal to or less than 10%.

5. The display system of claim 1, wherein the second look-up table at least defines a corresponding relationship between the original duty cycle and an original illumination value.

6. The display system of claim 1, wherein, the timing controller configured to determine a first mode or a second mode according to display data, wherein in the first mode, the timing controller increases a frequency of an original backlight control signal, wherein in the second mode, the timing controller increases a resolution of the original backlight control signal; and the display panel configured to be controlled based on the display data and the adjusted backlight control signal, to display the image.

7. The display system of claim 6, wherein the timing controller comprises:

a processor configured to output data according to the display data;

a timing signal generator configured to output a timing control signal; and a control circuit configured to determine the first mode and the second mode according to the display data, to output the adjusted backlight control signal, wherein the display panel is configured to receive the output data and the timing control signal.

8. The display system of claim 7, wherein the control circuit comprises:

a determination circuit configured to output a determination signal according to the display data; and a controller configured to adjust the original backlight control signal according to the determination signal, and output the adjusted backlight control signal to control a driver, such that the driver controls the backlight module of the display panel according to the adjusted backlight control signal.

9. The display system of claim 6, wherein the frequency is inversely proportional to the resolution.

10. The display system of claim 6, wherein the first mode corresponds to a high variation and the second mode corresponds to a low variation.

* * * * *